US012655703B2

(12) United States Patent
Han et al.

(10) Patent No.: US 12,655,703 B2
(45) Date of Patent: Jun. 16, 2026

(54) WATER-JET ICE CORE DRILLING RIG

(71) Applicant: Northwest Institute of Eco-Environment and Resources, Chinese Academy of Sciences, Lanzhou (CN)

(72) Inventors: Haidong Han, Lanzhou (CN); Feiteng Wang, Lanzhou (CN)

(73) Assignee: Northwest Institute of Eco-Environment and Resources, Chinese Academy of Sciences, Lanzhou (CN)

( * ) Notice: Subject to any disclaimer, the term of this patent is extended or adjusted under 35 U.S.C. 154(b) by 0 days.

(21) Appl. No.: 19/180,102

(22) Filed: Apr. 15, 2025

(65) Prior Publication Data

US 2026/0160141 A1 Jun. 11, 2026

(30) Foreign Application Priority Data

Jun. 18, 2024 (CN) ..... 202410787088.X

(51) Int. Cl.

| | |
|---|---|
| ***E21B 25/00*** | (2006.01) |
| ***E21B 7/00*** | (2006.01) |
| ***E21B 7/18*** | (2006.01) |
| ***E21B 17/18*** | (2006.01) |

(52) U.S. Cl.

CPC ..... *E21B 25/00* (2013.01); *E21B 7/008* (2013.01); *E21B 7/18* (2013.01); *E21B 17/18* (2013.01)

(58) Field of Classification Search

CPC . E21B 25/00; E21B 7/008; E21B 7/18; E21B 17/18

See application file for complete search history.

(56) References Cited

U.S. PATENT DOCUMENTS 12,435,588 B2 * 10/2025 Liu ..... E21B 10/605

FOREIGN PATENT DOCUMENTS

CN 114991674 A 9/2022

* cited by examiner

*Primary Examiner* — James G Sayre

(57) ABSTRACT

A water-jet ice core drilling rig includes a drilling barrel and a water-jet cutter head. Drilling barrel water channels are disposed on an inner barrel wall of the drilling barrel. The water-jet cutter head includes an inner pipe and an outer pipe. The inner pipe and the drilling barrel are coaxial. The inner pipe is fixedly connected to an end of the drilling barrel. First water passages are disposed on an outer side of an end of the inner pipe. The first water passages are uniformly distributed along a circumferential direction of the inner pipe. The first water passages are in one-to-one correspondence with the drilling barrel water channels. Each of the first water passages is connected with a corresponding one of the drilling barrel water channels. The outer pipe is sleeved outside the first water passages, the outer pipe is coaxially and fixedly connected to the inner pipe.

7 Claims, 9 Drawing Sheets

WATER-JET ICE CORE DRILLING RIG

TECHNICAL FIELD

The present disclosure relates to the technical field of ice core collection, and particularly to a water-jet ice core drilling rig.

BACKGROUND

Ice core analysis is an important research field of glacier research. By drilling an ice core along a direction from an ice surface to a bottom of a glacier in a suitable area of the glacier, and analyzing a crystal size, an impurity content and properties, a chemical isotope content, an air composition in a bubble, optical properties, contents of an organic matter and an inorganic matter of the ice core layer by layer, important information can be obtained, such as a development history of the glacier, characteristics and evolution sequence of paleoclimate, a sedimentary environment and an evolution process of the glacier, and dynamic characteristics of the glacier, which is an important research method for glaciologists to reveal paleoclimate and atmospheric environment, study evolution of glaciers and characteristics of modern glacier dynamics, and estimate future changes in glaciers.

A rotary ice core drilling rig is a main mechanical device for glaciologists to collect ice cores. Because of a simple structure and a lower failure rate of the rotary ice core drilling rig, the rotary ice core drilling rig is widely used in ice core drilling all over the world. However, in the long-term practice, the rotary ice core drilling rig has also revealed some disadvantages that an application environment of the rotary ice core drilling rig is limited.

1. A cutter head of the existing rotary ice core drilling rig is designed to be wedge-shaped and a cutting edge of the cutter head is straight, which helps to cut ice efficiently. However, when a content of moraine in the ice is higher, a rotating drilling barrel of the existing rotary ice core drilling rig drives the cutter head to directly cut hard moraine particles, which easily leads to the failure of cracking of the cutting edge, jamming of the cutter head and burning of an electric machine of the existing rotary ice core drilling rig. Therefore, the existing rotary ice core drilling rig is difficult to be applied to a glacier environment with a higher moraine content.

2. Ice holes drilled by the existing rotary ice core drilling rig are often curved, and multiple bends and non-straight holes are even formed, which extends a sampling path of the ice core, increases an analysis error of the ice core, and also raises the likelihood of the existing rotary ice core drilling rig getting stuck in the holes and being impossible to remove.

3. To provide a sufficient movement space at a rear of a truncation block as it rotates around a rotating shaft, a blocking plate of the rotating shaft is protrudingly installed on an outer wall of the rotating drilling barrel. As a result, the cutter head needs to be widened outward to prevent the protruding blocking plate from getting stuck during drilling. However, this design with the protruding blocking plate can still be one of causes of drill sticking, especially when drilling in maritime glaciers with higher temperatures. The reasons are as follows: in such glaciers, an ice has stronger plasticity, thereby making a drill hole more prone to deformation, which reduces a diameter of the drill hole and causes the existing rotary ice core drilling rig to get stuck in the drill hole and be impossible to remove from the drill hole.

SUMMARY

Objectives of the present disclosure is to overcome the problems in the prior art, and to provide a water-jet ice core drilling rig, which is suitable for ice core drilling in any glacier environment, especially in glacier ablation areas with a higher moraine content and other complex glacier environments. The water-jet ice core drilling rig ensures a higher verticality of a drill hole and is less likely to experience drill jamming. The water-jet ice core drilling rig solves the problem of damage of a cutter head and burnout of a motor due to jamming, which are common in an existing rotary ice core drilling rig when used in environments with a higher moraine content.

In an embodiment, the present disclosure provides a water-jet ice core drilling rig. The water-jet ice core drilling rig includes a drilling barrel and a water-jet cutter head. Drilling barrel water channels are disposed on an inner barrel wall of the drilling barrel. Each of the drilling barrel water channels is configured for connecting to a high-pressure water source. The water-jet cutter head includes an inner pipe and an outer pipe. The inner pipe and the drilling barrel are coaxial. The inner pipe is fixedly connected to an end of the drilling barrel. First water passages are disposed on an outer side of an end of the inner pipe facing towards the drilling barrel. The first water passages are uniformly distributed along a circumferential direction of the inner pipe. The first water passages are in one-to-one correspondence with the drilling barrel water channels. Each of the first water passages is connected with a corresponding one of the drilling barrel water channels. The outer pipe is sleeved outside the first water passages, the outer pipe is coaxially and fixedly connected to the inner pipe, and an annular water-jet nozzle is defined between the outer pipe and the inner pipe.

In an embodiment, an end of the inner pipe facing away from the drilling barrel protrudes from an end of the outer pipe facing away from the drilling barrel.

In an embodiment, the end of the inner pipe facing away from the drilling barrel protrudes from the end of the outer pipe by a length in a range of 1 mm to 2 mm.

In an embodiment, an outer diameter of the end of the inner pipe facing away from the drilling barrel is less than an outer diameter of the end of the outer pipe facing away from the drilling barrel by 0.5 mm to 1.5 mm.

In an embodiment, an upper cover is fixedly connected to an end of the drilling barrel facing away from the water-jet cutter head, an upper cover water channel is disposed in the upper cover, the upper cover water channel is connected with each of the drilling barrel water channels, and a high-pressure water pipe interface is disposed on the upper cover and is configured for connecting the upper cover water channel with the high-pressure water source.

In an embodiment, an eyebolt is disposed on a side of the upper cover facing away from the drilling barrel and is configured for connecting a traction cable harness.

In an embodiment, the high-pressure water pipe interface is disposed at a center of a side of the upper cover facing away from the drilling barrel, the upper cover water channel is two in number, the two upper cover water channels are perpendicular to each other and intersect at a center point of the upper cover, the two upper cover water channels are connected with the high-pressure water pipe interface, the drilling barrel water channels are four in number, and each end of each of the two upper cover water channels is connected with a corresponding one of the four drilling barrel water channels.

In an embodiment, an outer wall of the drilling barrel is smooth without protrusions.

In an embodiment, an extending direction of the drilling barrel water channels is parallel to an axis of the drilling barrel, the drilling barrel water channels are uniformly distributed along a circumferential direction of the drilling barrel, and an end of each of the drilling barrel water channels facing towards the water-jet cutter head is connected with a corresponding one of the first water passages.

In an embodiment, each of the first water passages is a boss-type water passage, an end of the drilling barrel facing towards the first water passage is provided with second water passages, the second water passages are recessed water passages, the first water passages are matched with the second water passages, and the first water passages are inserted into the second water passages and connected with the drilling barrel water channels.

Compared with the related art, the present disclosure has at least the following advantages.

1. A high-pressure water flow is utilized to form an annular high-pressure water-jet at a bottom of the drilling rig to impact and erode ice, thereby enabling drilling. The water-jet ice core drilling rig solves the problem of damage of a cutter head and burnout of a motor due to jamming, which are common in an existing rotary ice core drilling rig when used in environments with a higher moraine content. The high-pressure water flow can blow moraine out of the ice, preventing the moraine from accumulating at a bottom of a drill hole and obstructing a drilling process. Therefore, owing to no mechanical cutting head components or electronic components, a lower failure rate is achieved.

2. The water-jet ice core drilling rig of the present disclosure does not require a motor for rotational drive. As a result, there is no drilling direction deviation caused by a torque of the motor, and the drilling rig can advance vertically into a deeper position under the action of gravity, the drill hole has a higher verticality, and it is less likely to experience drill sticking.

3. The high-pressure water flow has a stronger impact on the ice, and a drilling speed is greatly accelerated compared with the existing rotary ice core drilling rig, which shortens a field operation period.

4. Compared with the existing rotary ice core drilling rig, which has high requirements for physical characteristics of a glacier at a drilling point, the water-jet ice core drilling rig of the present disclosure can be used for ice core drilling in any glacial environment, and is particularly suitable for drilling in glacier ablation zones with higher moraine content and other complex glacial environments.

5. The water-jet ice core drilling rig of the present disclosure has a simple structure, low requirements on material strength and processing technology, easy manufacture, low failure rate and easy maintenance.

DESCRIPTION OF REFERENCE NUMERALS

Figure 1:
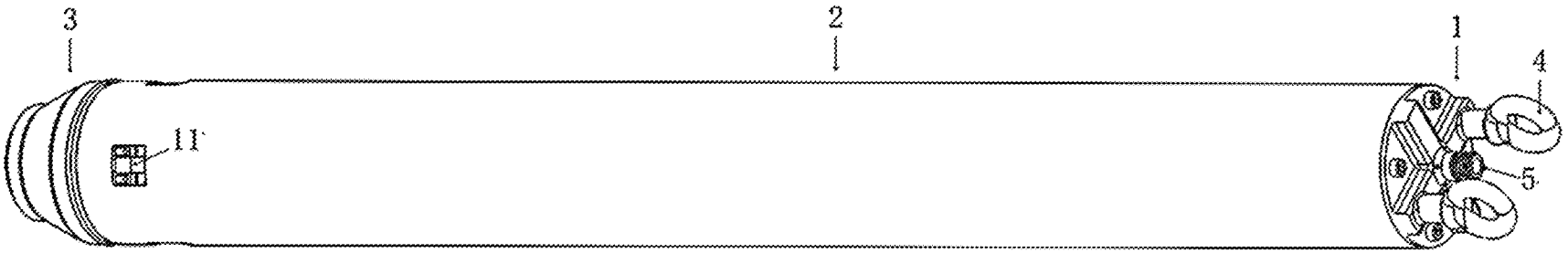
FIG. 1 illustrates a schematic structural diagram of an overall appearance of a water-jet ice core drilling rig according to an embodiment of the present disclosure.
Figure 2:
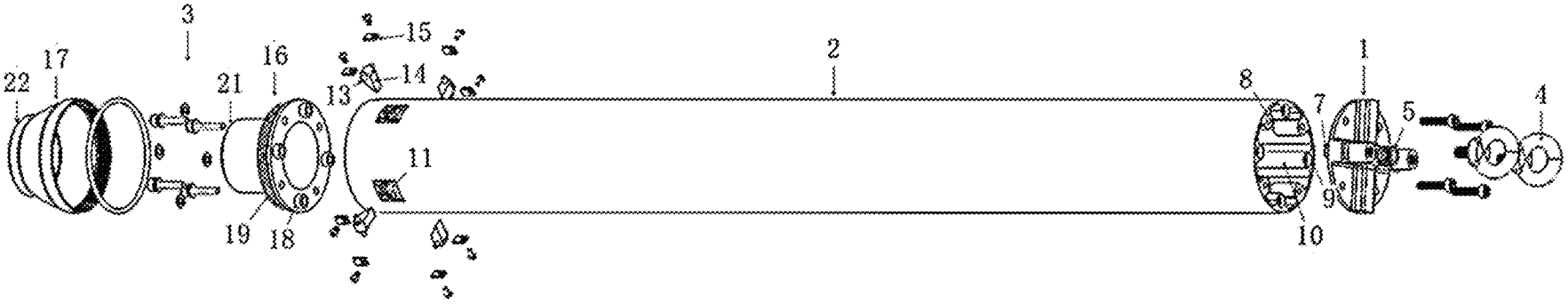
FIG. 2 illustrates a schematic overall explosion diagram of the water-jet ice core drilling rig according to the embodiment of the present disclosure.
Figure 3:
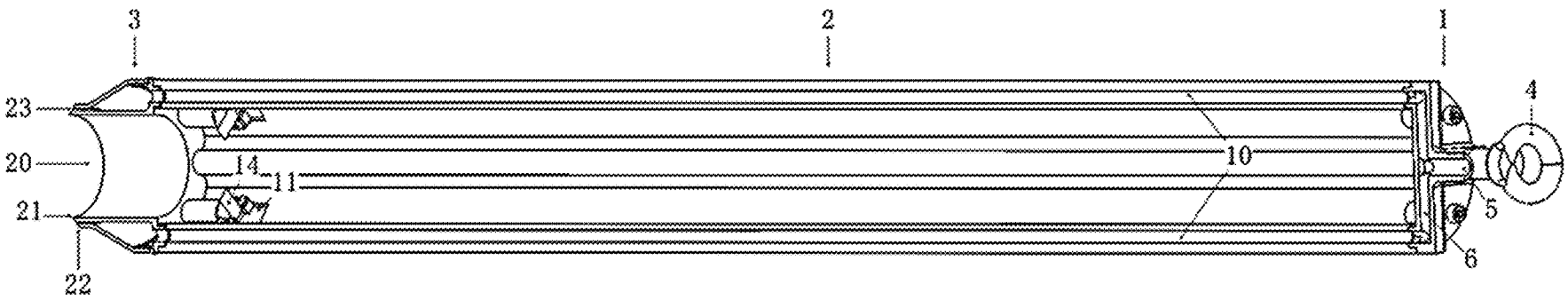
FIG. 3 illustrates a schematic longitudinal section view of the water-jet ice core drilling rig according to the embodiment of the present disclosure.
Figure 4:
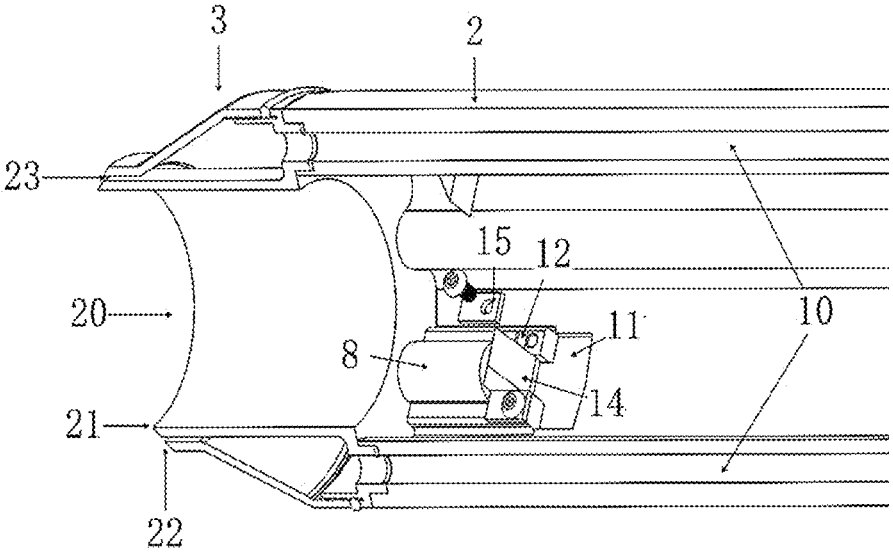
FIG. 4 illustrates an enlarged schematic view of a part of the schematic in longitudinal section view of the water-jet ice core drilling rig according to the embodiment of the present disclosure.
Figure 5:
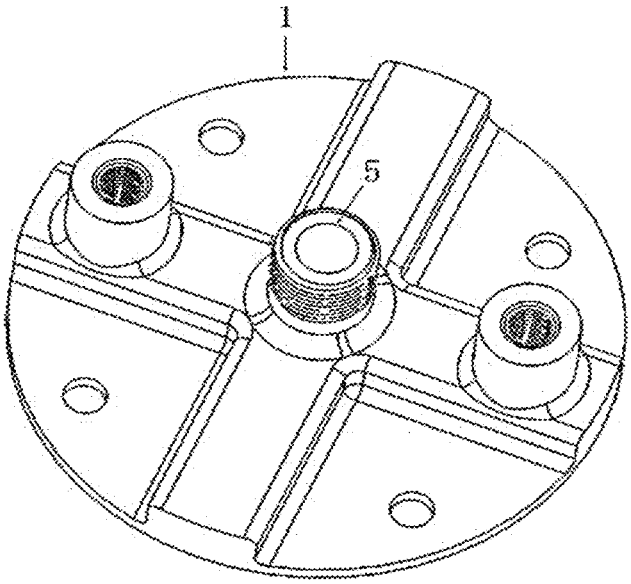
FIG. 5 illustrates a schematic structural diagram of an upper cover of the water-jet ice core drilling rig according to the embodiment of the present disclosure.
Figure 6:
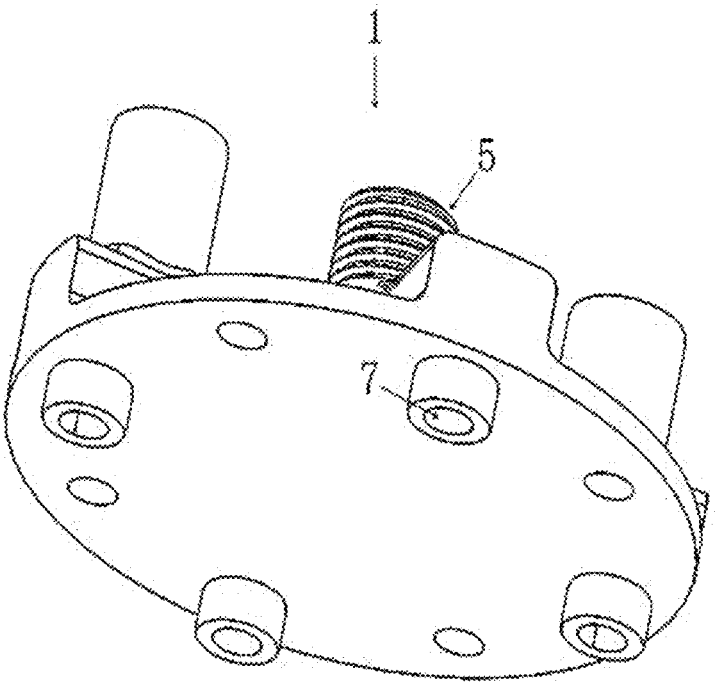
FIG. 6 illustrates a schematic structural diagram of a back side of the upper cover according to the embodiment of the present disclosure.
Figure 7:
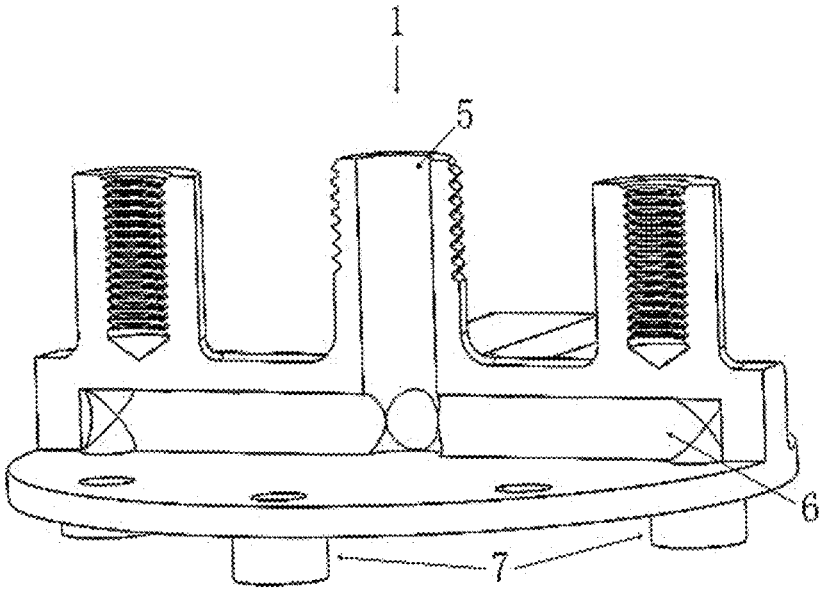
FIG. 7 illustrates a schematic section view of a front side of the upper cover according to the embodiment of the present disclosure.
Figure 8:
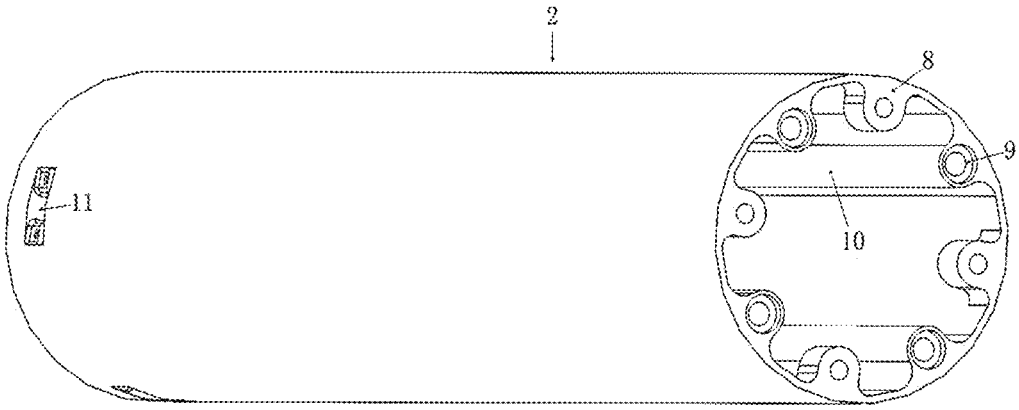
FIG. 8 illustrates a schematic structural diagram of a drilling barrel of the water-jet ice core drilling rig according to the embodiment of the present disclosure.
Figure 9:
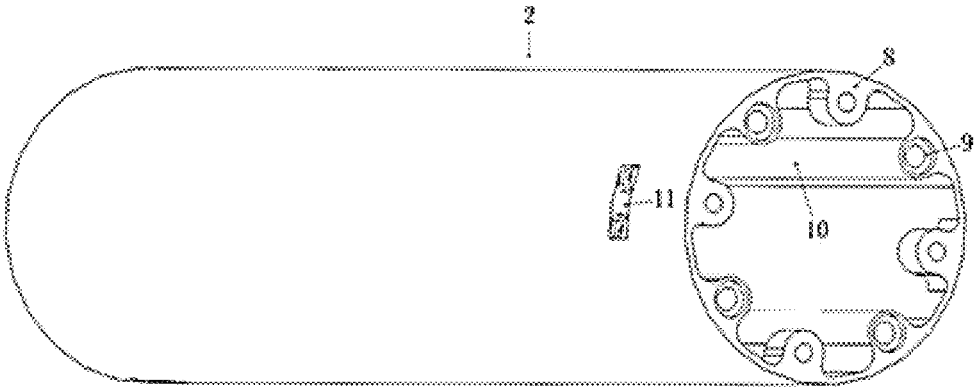
FIG. 9 illustrates another schematic structural diagram of a drilling barrel of the water-jet ice core drilling rig according to the embodiment of the present disclosure.
Figure 10:
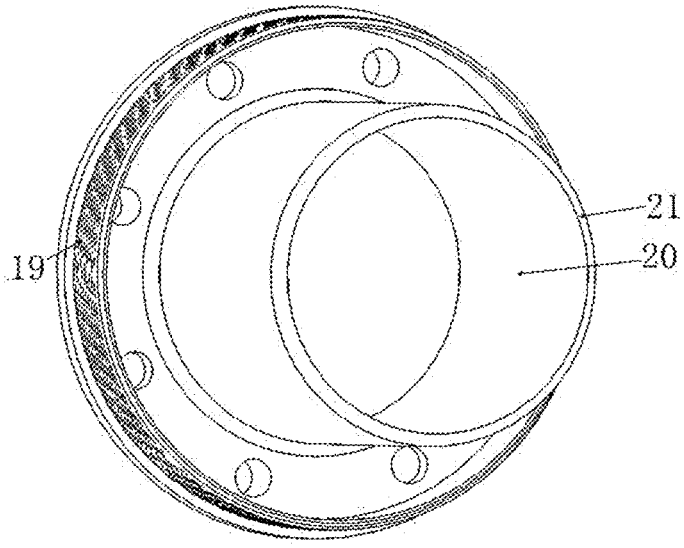
FIG. 10 illustrates a schematic structural diagram of a front side of an inner pipe of the water-jet cutter head of the water-jet ice core drilling rig according to the embodiment of the present disclosure.
Figure 11:
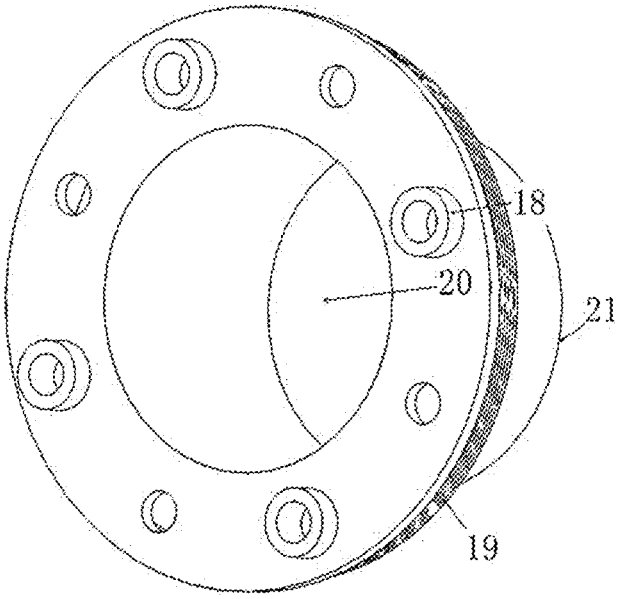
FIG. 11 illustrates a schematic structural diagram of a back side of the inner pipe of the water-jet cutter head of the water-jet ice core drilling rig according to the embodiment of the present disclosure.
Figure 12:
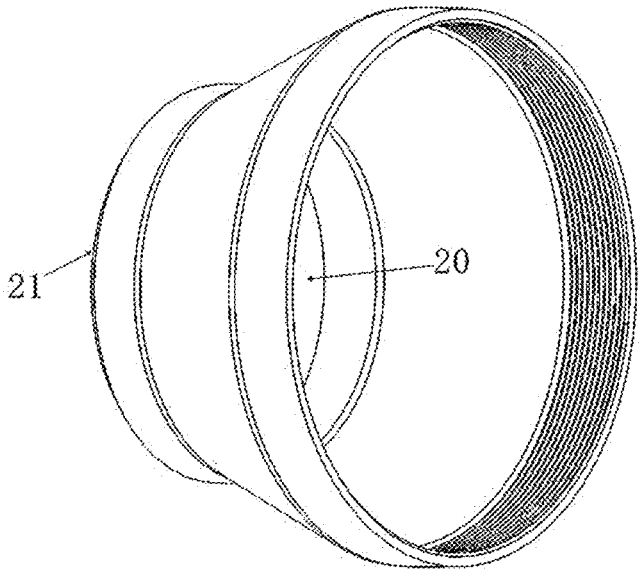
FIG. 12 illustrates a schematic structural diagram of an outer pipe of the water-jet ice core drilling rig according to the embodiment of the present disclosure.

1. Upper cover; 2. Drilling barrel; 3. Water-jet cutter head; 4. Eyebolt; 5. High-pressure water pipe interface; 6. Upper cover water channel; 7. Third water passage; 8. Screw mounting seat; 9. Second water passage; 10. Drilling barrel water channel; 11. Truncation block mounting port; 12. Shaft groove; 13. Rotating shaft; 14. Truncation block; 15. Blocking plate; 16. Inner pipe; 17. Outer pipe; 18. First water passage; 19, External thread; 20. Ice core through hole; 21. Inner pipe nozzle; 22. Outer pipe nozzle; 23. Annular water-jet nozzle; 24. Glacier; 25. Plunger pump; 26. Water inlet filter; 27. Ice lake; 28. Winch tube winder; 29. Traction cable harness; 30. Traction bracket; 31. Pulley; 32. Ice core.

DETAILED DESCRIPTION OF EMBODIMENTS

A rotary ice core drilling rig is a main mechanical device for glaciologists to collect ice cores. Because of a simple structure and a lower failure rate of the rotary ice core drilling rig, the rotary ice core drilling rig is widely used in ice core drilling all over the world. However, in the long-term practice, the rotary ice core drilling rig has also revealed some disadvantages that an application environment of the rotary ice core drilling rig is limited.

1. A straight cutting edge of a cutter head of the rotary ice core drilling rig cannot work normally in a glacier area with a higher moraine content. Different from a pure ice formed by freezing of rivers and lakes in winter, formation of a glacier ice mainly comes from the long-term accumulation of snow on an upper part of a glacier. Under the action of gravity, the snow in the lower layer is directly transformed from snow to ice by glaciation such as densification and metamorphic recrystallization. In the process of snow deposition and compaction, some rock debris and solid impurities in the air enter the snow with the action of ice avalanche, snowfall, and dry atmospheric deposition, and then change into impurities in the ice with the action of ice formation. In glaciology, these debris and impurities in the ice are called internal moraine, which means moraine in the ice. Therefore, the glacier ice is not a pure ice body, but an ice body generally containing internal moraine impurities. A particle size of the internal moraine varies from micron to several meters, but the internal moraine with a particle size of several millimeters to several centimeters is the most common. A content of the internal moraine in the ice varies greatly at different altitudes, depths and glaciers. Generally speaking, the content of the internal moraine gradually increases from an accumulation area in an upper part of the glacier to an ablation area in a lower part of the glacier. An average content of internal moraine in an extremely continental glacier formed in cold environment is lower than that in the marine glacier and valley glacier in warm environment, but higher than that in the flat-topped glacier or ice cap with open terrain. The cutter head of the rotary ice core drilling rig is designed to be wedge-shaped and a cutting edge of the cutter head is straight, which helps to cut ice efficiently. However, when a content of moraine in the ice is higher, a rotating drilling barrel of the existing rotary ice core drilling rig drives the cutter head to directly cut hard moraine particles, which easily leads to the failure of cracking of the cutting edge, jamming of the cutter head and burning of an electric machine of the existing rotary ice core drilling rig. Therefore, the existing rotary ice core drilling rig is difficult to be applied to a glacier environment with a higher moraine content.

2. Ice holes drilled by the existing rotary ice core drilling rig are often curved, and multiple bends and non-straight holes are even formed, which extends a sampling path of the ice core, increases an analysis error of the ice core, and also raises the likelihood of the existing rotary ice core drilling rig getting stuck in the holes and being impossible to remove. Because a motor itself is acted by the reverse torque in the process of driving the drilling barrel and a drill bit to rotate, a pair of forward and reverse torques acts on the drill bit at a bottom and the motor at a top respectively, which makes the long-strip drilling rig always tilt to one side, thus causing bending of a drill hole. In addition, because the drilling of the rotary ice core drilling rig in the ice is autonomous drilling, a driving force of drilling comes from a pressure of the drilling rig's gravity on the drill bit on the one hand, and comes from a reaction force obtained by a spiral groove of the drilling barrel in a process of pushing the ice chips on the other hand. Because the drilling rig is only connected with the outside through flexible bodies such as wire ropes and cables, an operator can't accurately control a drilling direction of the drilling rig, so the drilling direction is difficult to keep vertically downward and often curved. Because a diameter of the drill hole drilled by the rotary ice core drilling rig is a maximum diameter of the cutter head, the drill hole shrinkage caused by the bending drill hole and the release of internal stress of ice and the deformation of ice crystals makes it common for the drilling rig to get stuck in the drill hole, which often leads to the consequences of the drilling rig being unable to be recovered and the drill hole being scrapped. This problem is very prominent when drilling for hundreds of meters or thousands of meters, resulting in the loss of huge scientific research funds.

3. To provide a sufficient movement space at a rear of a truncation block as it rotates around a rotating shaft, a blocking plate of the rotating shaft is protrudingly installed on an outer wall of the rotating drilling barrel. As a result, the cutter head needs to be widened outward to prevent the protruding blocking plate from getting stuck during drilling. However, this design with the protruding blocking plate can still be one of causes of drill sticking, especially when drilling in maritime glaciers with higher temperatures. The reasons are as follows: in such glaciers, an ice has stronger plasticity, thereby making a drill hole more prone to deformation, which reduces a diameter of the drill hole and causes the existing rotary ice core drilling rig to get stuck in the drill hole and be impossible to remove from the drill hole.

In order to overcome the above shortcomings of the traditional rotary ice core drilling rig, the disclosure abandons a coring idea of mechanical cutting and precession, adopts a coring method of water jet impact drilling, and uses a high-pressure water flow to form an annular water jet at a drill bit to impact and break and dissolve the ice, so that internal moraine with a smaller particle size is peeled off from the ice under the action of high-speed water flow and cannot be deposited at a bottom of a drill hole to hinder drilling, and the drilling rig has no rotating parts and rotating torque, and can generate a vertical drill hole under the action of gravity. In addition, a reverse water flow after impacting the bottom of the drill hole continues to impact and erode an outer wall of the drill hole, so that the drill hole with a diameter more than 10% of a diameter of the drilling rig can be formed, and the occurrence of drilling sticking is avoided. The water-jet ice core drilling rig of the present disclosure has the characteristics of a simpler structure, fewer parts and lower failure rate, and is very suitable for coring operation in glacier areas with high internal moraine content and complex internal structure.

In the following, specific embodiments of the present disclosure will be described in detail with reference to FIG. 1 through FIG. 14, but it should be understood that the scope of protection of the present disclosure is not limited by the described specific embodiments. Based on the described embodiments in the present disclosure, all other embodiments obtained by ordinary technicians in the field without creative work belong to the scope of protection of the present disclosure.

In an embodiment, a water-jet ice core drilling rig is provided, which includes a drilling barrel 2 and a water-jet cutter head 3. Two end faces of the drilling barrel 2 have symmetrical structures. Each of the two end faces is provided with four screw mounting seats 8 and four second water passages 9. The four screw mounting seats 8 are circumferentially symmetrical. The four second water passages 9 are circumferentially symmetrical. The four second water passages 9 at two ends of the drilling barrel 2 are respectively connected to four drilling barrel water channels 10. The drilling barrel 2 defines an ice core through hole 20. The water-jet cutter head 3 includes an inner pipe 16 and an outer pipe 17. The inner pipe 16 is coaxially and fixedly connected with an end of the drilling barrel 2. An outer side of an end of the inner pipe 16 facing towards the drilling barrel 2 is provided with an annular seat, and the annular seat and the inner pipe 16 are coaxial. Four first water passages 18 are disposed on the annular seat. The four first water passages 18 are uniformly along a circumferential direction of the inner pipe 16. The four first water passages 18 are in one-to-one correspondence with the four drilling barrel water channels 10. Each of the four first water passages 18 is connected with a corresponding one of the four drilling barrel water channels 10 via a corresponding one second water passage 9 facing towards the water-jet cutter head 3. An outer side of the annular seat is provided with an external thread 19, and the outer pipe 17 is sleeved outside the annular seat. The outer pipe 17 is in sealing and screwing connection with the annular seat through the external thread 19, so that an annular water-jet nozzle 23 is defined between the outer pipe 17 and the inner pipe 16. Each of the four screw mounting seats 8 on a side of the drilling barrel 2 facing towards the water-jet cutter head 3 is provided with a truncation block mounting port 11, a boss is disposed on an inner wall of the drilling barrel 2 and corresponds to the truncation block mounting port 11 for mounting a truncation block 14, and a shaft groove 12 is defined in the boss. A rotating shaft 13 penetrates through the truncation block 14. Two ends of the rotating shaft 13 are rotatably connected in the shaft groove 12, and the two ends of the rotating shaft 13 are limited by the locking plate 15. A wedge tip of the truncation block 14 is disposed to face towards an inside of the drilling barrel 2 and an inclined surface of the truncation block 14 is disposed to point to the water-jet cutter head 3. When a bottom plane of the truncation block 14 is in contact with a bottom of the screw mounting seat 8, the truncation block 14 can be supported by the screw mounting seat 8, so that the truncation block 14 can freely rotate around the rotating shaft 13 within a range of 60° in a direction from this position towards the upper cover 1. The four drilling barrel water channels 10 are disposed on an inner barrel wall of the drilling barrel 2 and each of the drilling barrel water channels 10 is configured for connecting to a high-pressure water source.

In an embodiment, an end of the inner pipe 16 facing away from the drilling barrel 2 is an inner pipe nozzle 21, and an end of the outer pipe 17 facing away from the drilling barrel 2 is an outer pipe nozzle 22. The inner pipe nozzle 21 protrudes from the outer pipe nozzle 22, and the annular water-jet nozzle 23 is formed between the inner pipe nozzle 21 and the outer pipe nozzle 22.

In an embodiment, the inner pipe nozzle 21 protrudes from the outer pipe nozzle 22 by 1 mm to 2 mm.

In an embodiment, a difference between an outer diameter of the inner pipe nozzle 21 and an inner diameter of the outer pipe nozzle 22 is 0.5 mm~1.5 mm, which can ensure an outlet water pressure and a strength of the formed annular water jet, and ensure the drilling stability of the drilling barrel 2.

In an embodiment, an end of the drilling barrel 2 facing away from the water-jet cutter head 3 is fixedly connected to an upper cover 1 via the four screw mounting seats 8, and the upper cover 1 is internally provided with an upper cover water channel 6 which is connected with the four drilling barrel water channels 10. The upper cover 1 is also provided with a high-pressure water pipe interface 5, and a high-pressure water source is connected with the upper cover water channel 6 via the high-pressure water pipe interface 5.

In an embodiment, a side of the upper cover 1 facing away from the drilling barrel 2 is fixedly connected to an eyebolt 4 for connecting a traction cable harness 29.

In an embodiment, the high-pressure water pipe interface 5 is disposed at a center of a side of the upper cover 1 facing away from the drilling barrel 2. The upper cover water channel 6 is two in number, and the two upper cover water channels 6 are perpendicular to each other and intersect at a center point of the upper cover 1. The two upper cover water channels 6 are connected with the high-pressure water pipe interface 5. The drilling barrel water channels 10 are four in number. The four second water passages 9 are recessed water passages, and two ends each of the two upper cover water channels 6 are provided with two third water passage 7, respectively. Each third water passage 7 is connected with a corresponding drilling barrel water channel 10 by inserting a corresponding second water passage 9 facing towards the upper cover 1. Specifically, in order to make the drilling barrel 2 accommodate an ice core with a largest diameter as possible, a size of the drilling barrel water channel 10 needs to be as small as possible, generally, an inner diameter of the drilling barrel water channel 10 is in a range of 4-6 mm, and a wall thickness of the drilling barrel water channel 10 is in a range of 2-2.5 mm for bearing pressure, so as to leave enough space. Further, an inner diameter of the high-pressure water pipe interface 5 is generally more than 12 mm, and the drilling barrel water channels 10 are selected for simultaneous transportation, which ensures smooth conveyance of the high-pressure water flow, reducing energy loss or head loss of the water.

In an embodiment, an outer wall of the drilling barrel 2 is smooth without protrusions, which can reduce the possibility that the drilling barrel 2 deviates during drilling, and at the same time, reduce a deviation degree of the drilling barrel 2 during drilling.

In an embodiment, the four drilling barrel water channels 10 are parallel to an axis of the drilling barrel 2, and the four drilling barrel water channels 10 are uniformly distributed along a circumferential direction of the drilling barrel 2. An end of each of the drilling four barrel water channels 10 facing towards the water-jet cutter head 3 is connected with a corresponding one of the first water passages 18, and the four drilling barrel water channels 10 are circumferentially symmetrical and uniformly stressed, which is convenient for processing.

In an embodiment, each of the four first water passages 18 is a boss-type water passage, an end of the drilling barrel 2 facing towards the first water passage 18 is provided with four second water passages 9, the four second water passages 9 are four recessed water passages, the four first water passages 18 are matched with the four second water passages 9, and the four first water passages 18 are inserted into ends of the four second water passages 9 facing towards the water-jet cutter head 3 and connected with the drilling barrel water channels 10. This technical solution enhances the sealing of the connection between the four first water passages 18 and the four second water passages 9 and facilitates the connection.

Figure 13:
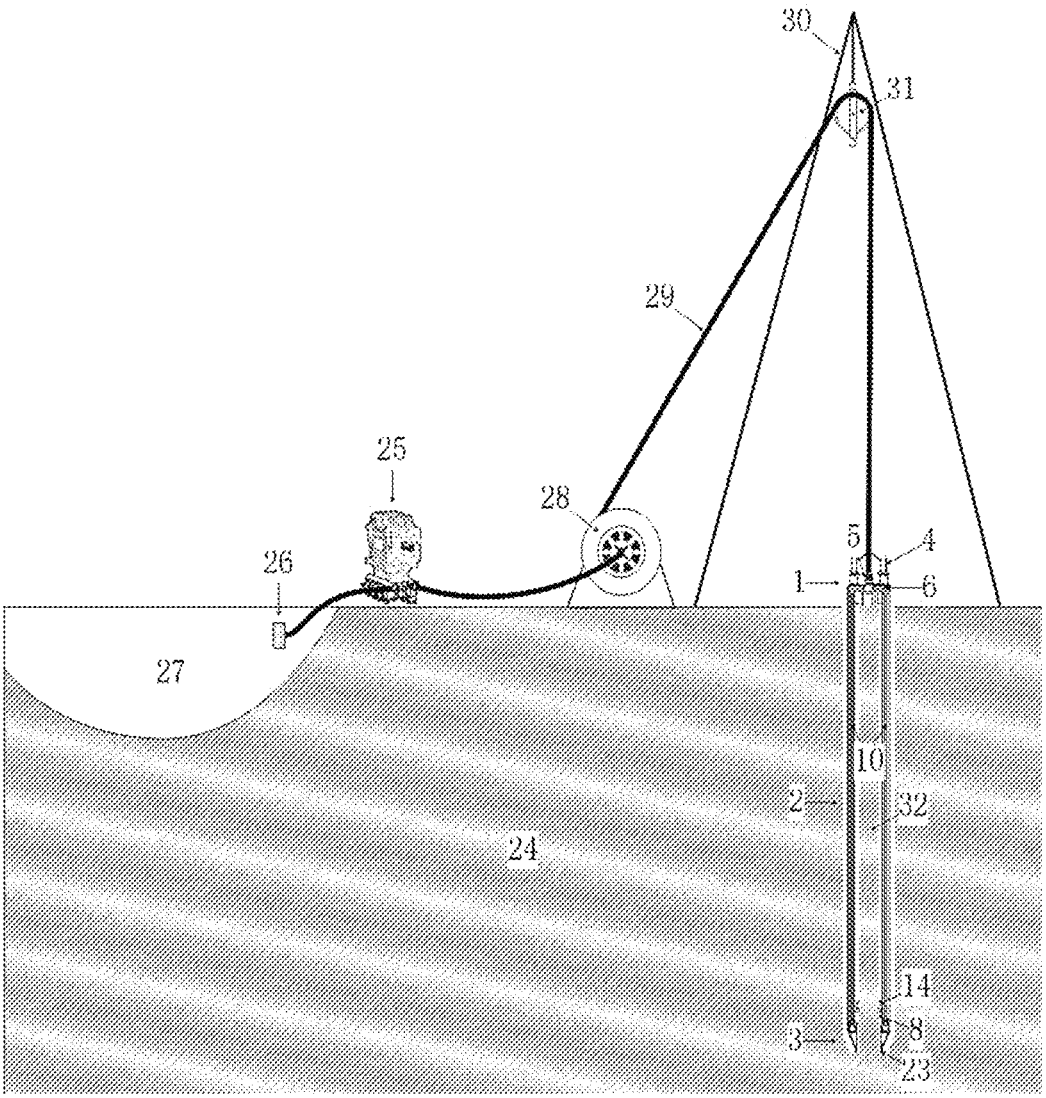
FIG. 13 illustrates a schematic diagram of a drilling action of the water-jet ice core drilling rig according to the embodiment of the present disclosure.
Figure 14:
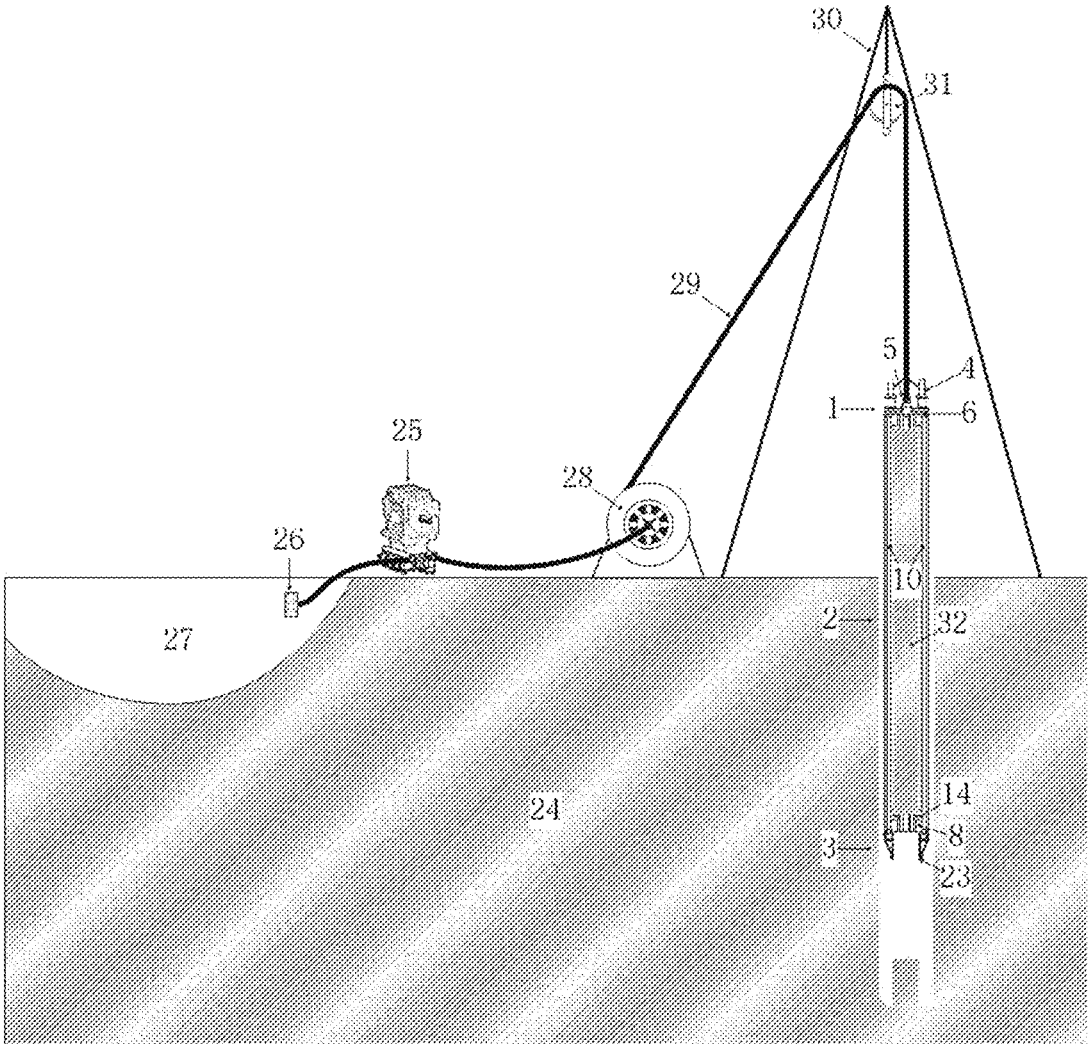
FIG. 14 illustrates a schematic diagram of a coring operation of the water-jet ice core drilling rig according to the embodiment of the present disclosure.

As illustrated in FIG. 13, in a working area of a glacier 24, a water inlet of a plunger pump 25 driven by a portable engine or an electric motor is connected to a water inlet filter 26 through a low-pressure water pipe, and water is directly taken from glacier water sources such as an ice lake, an ice river and an ice well or water is transferred through a large-capacity portable container. In this example, the water inlet filter 26 is directly put into an ice lake 27 to take water. A water outlet of the plunger pump 25 provides a high-pressure water flow with a pressure of 3 MPa, which enters a water inlet of the winch tube winder 28. A water outlet of the winch tube winder 28 is connected to a high-pressure water pipe. The high-pressure water pipe together with a traction wire rope and a tape measure, forms a traction cable harness 29. An end of the traction cable harness 29 is accommodated on the winch tube winder 28, and the other end of the traction cable harness 29 is connected to the upper cover 1 of the water-jet ice core drilling rig via the pulley 31 hoisted on the traction bracket 30. The high-pressure water pipe is connected to the high-pressure water pipe interface 5 of the upper cover 1 to input the high-pressure water flow into the drilling barrel. The traction harness 29 is connected to the eyebolt 4 to provide main traction. When a drilling process is performed, a traction force applied to the water-jet ice core drilling rig by the traction cable harness 29 should be smaller, and it is only necessary to keep the water-jet ice core drilling rig in a vertical state.

The high-pressure water flow entering the high-pressure water pipe interface 5 sequentially passes through the upper cover water channel 6 and the drilling barrel water channel 10, enters a cavity between the inner pipe 16 and the outer pipe 17 at a bottom of the water-jet ice core drilling rig, and is sprayed out at a higher speed through the annular water-jet nozzle 23, thereby forming a high-pressure annular jet. The annular high-pressure jet forms an annular high-pressure water jet at the bottom of the water-jet ice core drilling rig, and the drilling process is performed by impacting and eroding ice. Since the inner pipe nozzle 21 protrudes from the outer pipe nozzle 22 by a length of 1 mm to 2 mm, when the inner pipe nozzle 21 is pressed tightly against a surface of the ice, the annular water-jet nozzle 23 between the inner pipe nozzle 21 and the outer pipe nozzle 22 will not be blocked by the surface of the ice and internal moraine, allowing the high-pressure water flow to smoothly impact the ice around an outer edge of the inner pipe nozzle 21, while the ice inside an inner edge of the inner pipe nozzle 21 is protected by a wall of the drilling barrel 2 and forms an ice core 32.

The ice is continuously broken down under the continuous impact, fragmentation, and dissolution of the high-pressure water flow from the annular water-jet nozzle 23. Further, the high-speed water flow, blocked by a frontal ice body, changes direction and continues to fragment and erode a lateral ice body, thereby expanding a drill hole. As the ice body below the annular water-jet nozzle 23 is broken down, the water-jet ice core drilling rig moves downward under the force of gravity, and the ice core 32 enters the drilling barrel 2 through the ice core through hole 20. When the ice core 32 passes through the truncation block 14, since the truncation block 14 can flip upward around the rotating shaft 13, the truncation block 14 will not obstruct the passage of the ice core 32.

When the drilling process begins, an operator should record an initial length of the tape measure in the traction cable harness 29. As the water-jet ice core drilling rig advances, when a length of the measuring tape that has been lowered equals or approaches a maximum length of an ice core that the drilling barrel 2 can accommodate (initial calculation should account for an ineffective ice core length between the truncation block 14 and the inner pipe nozzle 21), the plunger pump 25 stops supplying water, and the operator pulls the traction cable harness 29 manually or with mechanical assistance. As such, the truncation block 14 moves upward with the drilling barrel 2, and wedge tip of the truncation block 14 is squeezed inward and pierces the ice core 32 to cut the ice core off. Truncation block 14 is supported by the screw mounting seat 8, therefore, the truncation block 14 holds the cut ice core 32 into the drilling barrel 2. Thus, the ice core 32 can be lifted out of the drill hole along with the water-jet ice core drilling rig. After the water-jet ice core drilling rig is removed, the upper cover 1 can be detached to extract the ice core 32, which is then arranged in sequence, numbered, and processed for sample collection. By repeating the above operations, continuous drilling and collection of ice cores 32 from a deep region of the glacier can be achieved.

In the description of the present disclosure, it should be noted that in the present disclosure, relational terms such as first and second are used solely to distinguish one entity or operation from another, and do not necessarily imply any actual relationship or sequence between these entities or operations. Moreover, the terms "comprising," "including," or any other variants are intended to cover non-exclusive inclusion, thereby allowing a process, method, item, or device that includes a series of elements to also include other elements not explicitly listed, or to include inherent elements of such process, method, item, or device. In the absence of further limitations, an element defined by the phrase "comprising a . . . " does not exclude the existence of additional identical elements in the process, method, item, or device that includes the said element.

In the description of this disclosure, it should also be noted that, unless otherwise explicitly specified and limited, the terms "disposed," "mounted," "connected," and "coupled" should be broadly understood. For example, these terms may refer to fixed connections, detachable connections, or integral connections; these terms may refer to mechanical connections or electrical connections; these terms may refer to direct connections or indirect connections through intermediate media, or these terms may refer to internal connection between two components. For ordinary technicians in the art, the specific meanings of the above terms in the present disclosure can be understood according to the specific context.

Although embodiments of the present disclosure have been shown and described, it should be understood by those of ordinary skill in the art that various changes, modifications, substitutions, and variations can be made to these embodiments without departing from the principles and spirit of this disclosure. The scope of protection of the present disclosure is defined by the appended claims and their equivalents.

What is claimed is:

1. A water-jet ice core drilling rig, comprising:

a drilling barrel (2), wherein drilling barrel water channels (10) are disposed on an inner barrel wall of the drilling barrel (2); and a water-jet cutter head (3), wherein the water-jet cutter head (3) comprises an inner pipe (16) and an outer pipe (17), the inner pipe (16) and the drilling barrel (2) are coaxial, the inner pipe (16) is fixedly connected to an end of the drilling barrel (2), first water passages (18) are disposed on an outer side of an end of the inner pipe (16) facing towards the drilling barrel (2), the first water passages (18) are uniformly distributed along a circumferential direction of the inner pipe (16), the first water passages (18) are in one-to-one correspondence with the drilling barrel water channels (10), each of the first water passages (18) is connected with a corresponding one of the drilling barrel water channels (10), the outer pipe (17) is sleeved outside the first water passages (18), the outer pipe (17) is coaxially and fixedly connected to the inner pipe (16), and an annular water-jet nozzle (23) is defined between the outer pipe (17) and the inner pipe (16), wherein an end of the inner pipe (16) facing away from the drilling barrel (2) protrudes from an end of the outer pipe (17) facing away from the drilling barrel (2), and the end of the inner pipe (16) facing away from the drilling barrel (2) protrudes from the end of the outer pipe (17) by a length in a range of 1 mm to 2 mm, and an outer diameter of the end of the inner pipe (16) facing away from the drilling barrel (2) is 0.5 mm to 1.5 mm smaller than an outer diameter of the end of the outer pipe (17) facing away from the drilling barrel (2) by 0.5 mm to 1.5 mm.

2. The water-jet ice core drilling rig as claimed in claim 1, wherein an outer wall of the drilling barrel (2) is smooth without protrusions.

3. The water-jet ice core drilling rig as claimed in claim 1, wherein an extending direction of the drilling barrel water channels (10) is parallel to an axis of the drilling barrel (2), the drilling barrel water channels (10) are uniformly distributed along a circumferential direction of the drilling barrel (2), and an end of each of the drilling barrel water channels (10) facing towards the water-jet cutter head (3) is connected with a corresponding one of the first water passages (18).

4. The water-jet ice core drilling rig as claimed in claim 1, wherein an end of the drilling barrel (2) facing towards the first water passages (18) is provided with second water passages (9), the second water passages (9) are recessed water passages, the first water passages (18) are matched with the second water passages (9), and the first water passages (18) are disposed to be inserted into the second water passages (9) and connected with the drilling barrel water channels (10).

5. The water-jet ice core drilling rig as claimed in claim 1, wherein an upper cover (1) is fixedly connected to an end of the drilling barrel (2) facing away from the water-jet cutter head (3), an upper cover water channel (6) is disposed in the upper cover (1), the upper cover water channel (6) is connected with the drilling barrel water channels (10), and a high-pressure water pipe interface (5) is disposed on the upper cover (1).

6. The water-jet ice core drilling rig as claimed in claim 5, wherein an eyebolt (4) is disposed on a side of the upper cover (1) facing away from the drilling barrel (2) and is configured for connecting a traction cable harness (29).

7. The water-jet ice core drilling rig as claimed in claim 5, wherein the high-pressure water pipe interface (5) is disposed at a center of a side of the upper cover (1) facing away from the drilling barrel (2), the upper cover water channel (6) is two in number, the two upper cover water channels (6) are perpendicular to each other and intersect at a center point of the upper cover (1), the two upper cover water channels (6) are individually connected with the high-pressure water pipe interface (5), the drilling barrel water channels (10) are four in number, and each end of each of the two upper cover water channels (6) is connected with a corresponding one of the four drilling barrel water channels (10).

* * * * *